US010294061B1

(12) United States Patent
Renkert et al.

(10) Patent No.: US 10,294,061 B1
(45) Date of Patent: May 21, 2019

(54) SPRING-ENABLED STRIPWISE ADHESIVE DISPENSER

(71) Applicants: Michael F. Renkert, Port Orchard, WA (US); Kevin G. Shumway, Port Orchard, WA (US)

(72) Inventors: Michael F. Renkert, Port Orchard, WA (US); Kevin G. Shumway, Port Orchard, WA (US)

( * ) Notice: Subject to any disclaimer, the term of this patent is extended or adjusted under 35 U.S.C. 154(b) by 0 days.

(21) Appl. No.: 15/882,124

(22) Filed: Jan. 29, 2018

(51) Int. Cl.
*B29C 65/50* (2006.01)
*B65H 35/00* (2006.01)

(52) U.S. Cl.
CPC ..... *B65H 35/0026* (2013.01); *B65H 35/0086* (2013.01)

(58) Field of Classification Search
CPC ..... B65H 35/0026; B65H 35/0086
USPC ..... 225/65, 51
See application file for complete search history.

(56) References Cited

U.S. PATENT DOCUMENTS 2,473,072 A * 6/1949 Plouff ..... A01K 89/00 83/610
2,817,404 A * 12/1957 Vogt ..... B65H 35/0026 225/51
3,902,956 A * 9/1975 Thompson, Jr. ... B65H 35/0033 156/523
7,441,581 B2 * 10/2008 Pitzen ..... B65H 35/0033 156/574

* cited by examiner

*Primary Examiner* — Omar Flores Sanchez
(74) *Attorney, Agent, or Firm* — Galvin Patent Law LLC; Brian R. Galvin

(57) ABSTRACT

A spring-enabled strip adhesive dispenser device of a generally bisected lachrymiform-type shape with a cut-out circular center for springs and adhesive to attach to, having solid walls formed of a solid material such as metal or plastic, where one end tapers to a narrower width with a cut-out circular shape and two uniform cut-out rectangular shapes for attaching cutting blade to device.

4 Claims, 5 Drawing Sheets

SPRING-ENABLED STRIPWISE ADHESIVE DISPENSER

BACKGROUND OF THE INVENTION

Field of the Art

The disclosure relates to the field of stripwise adhesive dispensers, and more particularly to a spring-enabled, stripwise adhesive dispenser with cutting blade.

Discussion of the State of the Art

In the field of painting, precision is a necessity for painters. Trim work in housing and other types of buildings needs to be covered during the process of painting walls, while the corners and edges of walls and ceilings need to be covered when more than one color is used. Crisp lines, colors not running together, and paints not being mixed are all part of the precision techniques of painting. Caulking is also a precision skill; areas next to those that are being caulked need to be covered so that they are not accidentally caulked as well.

Painters often use an adhesive in the form of a strip (such as tape) to cover trims, corners, edges, and other parts that need protection from the paint and caulking process. Painters also use stripwise adhesives as a form of stenciling when tasked with painting designs and patterns. Stripwise adhesives come in many width sizes depending upon the brand and use or need per project. Even within the same brand, a width size may vary (so a 1-inch width size by a particular brand could sometimes be wider or thinner than 1-inch) during the manufacturing process. Stripwise adhesive cores (oftentimes a cardboard cylinder around which adhesive is wrapped) can also vary in sizes and positions relative to wound adhesive during manufacturing. This makes using a single dispenser difficult; a painter would need a dispenser for each width size, and sometimes the adhesive roll still won't fit into the dispenser due to an oversized or poorly positioned core. This results in purchasing multiple products, making stripwise adhesives costly, as well as cumbersome (since a painter would need to carry several products for the same purpose).

What is needed, then, is a means to provide a single adjustable dispensing device that can accommodate multiple width sizes of adhesive as well as multiple core sizes or relative positions, so that precision is achieved without a painter needing to purchase several of the same dispensing products to achieve greater precision.

SUMMARY OF THE INVENTION

Accordingly, the inventor has conceived and reduced to practice, in a preferred embodiment of the invention, a device for an adjustable stripwise adhesive dispenser that will accommodate varying width sizes of stripwise adhesives and adhesive cores.

In a preferred embodiment of the invention, a stripwise adhesive dispensing device is disclosed, comprising a bisected lachrymiform body formed from a rigid material and having a bottom portion having a first width, a tapered top portion having a smaller second width, a plurality of circular cut-outs formed into the body, a cutting blade, and a plurality of springs. According to the embodiment, at least a circular cut-out is configured to hold a spring; the bisected lachrymiform and the held spring are configured to hold stripwise adhesive securely in place; and the held stripwise adhesive is positioned and oriented for dispensation without interfering with or damaging an adhesive portion of the held stripwise adhesive.

BRIEF DESCRIPTION OF THE DRAWING FIGURES

The accompanying drawings illustrate several embodiments of the invention and, together with the description, serve to explain the principles of the invention according to the embodiments. It will be appreciated by one skilled in the art that the particular embodiments illustrated in the drawings are merely exemplary, and are not to be considered as limiting of the scope of the invention or the claims herein in any way.

DETAILED DESCRIPTION

Detailed Description of Exemplary Embodiments

Figure 1:
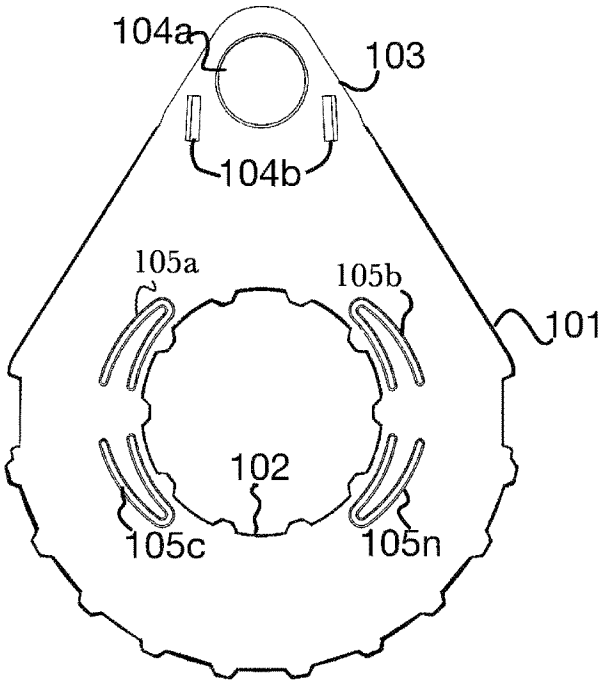
FIG. 1 is an illustration of an exemplary stripwise adhesive dispenser according to a preferred embodiment of the invention, illustrating a top side view of device design.

FIG. 1 is an illustration of an exemplary stripwise adhesive dispenser according to a preferred embodiment of the invention, illustrating a top side view 100 of device design.

According to the embodiment, stripwise adhesive dispenser 100 may comprise a generally bisected lachrymiformbody 101 with a circular center 102 cut out of the middle of the first width bottom portion of lachrymiform shape 101, for springs to be molded (either directly into underside of lachrymiform shape 101 or attached to—as in not built in directly to dispenser 100—to the underside of lachrymiform shape 101) to hold stripwise adhesive in place (generally, a bisected lachrymiform shape to be assembled as illustrated; however, it should be appreciated that other final shapes may be used according to a desired arrangement or use case, such as an oblong shape or a rectangular shape, or other arrangement, having solid walls 101 formed of a rigid material such as metal or plastic, where one end tapers to a smaller second width 103 with a circular shape 104*a* cut out along with two uniform rectangular shapes 104*b* cut out for cutting blade to assemble to device; and also having a plurality of uniform shapes cut out 105*a-n* around center 102 for holding stripwise adhesive core in place while dispenser is in use.

Figure 2:
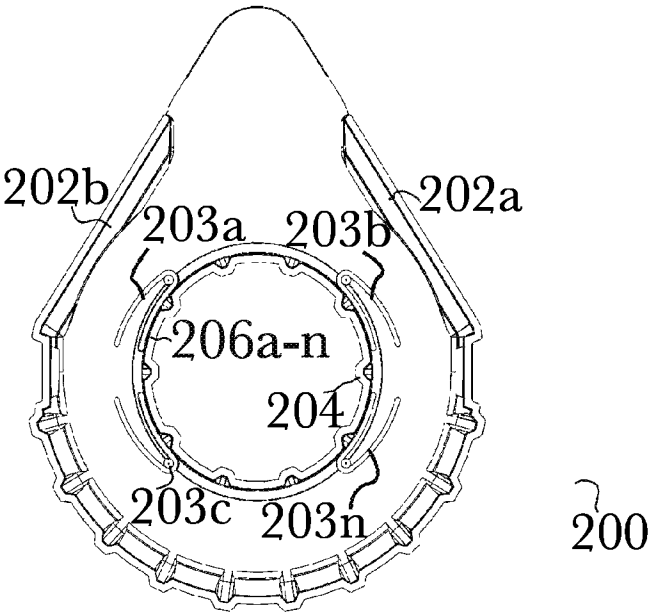
FIG. 2 is an illustration of an exemplary stripwise adhesive dispenser according to a preferred embodiment of the invention, illustrating a bottom side view of device design.

FIG. 2 is an illustration of an exemplary stripwise adhesive dispenser according to a preferred embodiment of the invention, illustrating a bottom side view 200 of device design. According to the embodiment, stripwise adhesive dispenser 201 has two bumpers 202*a*, 202*b* to guide stripwise adhesive towards cutting blade 402 when in use. Cut-outs 105*a-n* are cut around a plurality of stationary lever arms 203*a-n* that each have a rounded nodule at their tip, for holding core of stripwise adhesive in place when in use. Circular center 102, 206*a-n* has indentations 204 where springs are built-in or affixed, to hold stripwise adhesive in place.

Figure 3:
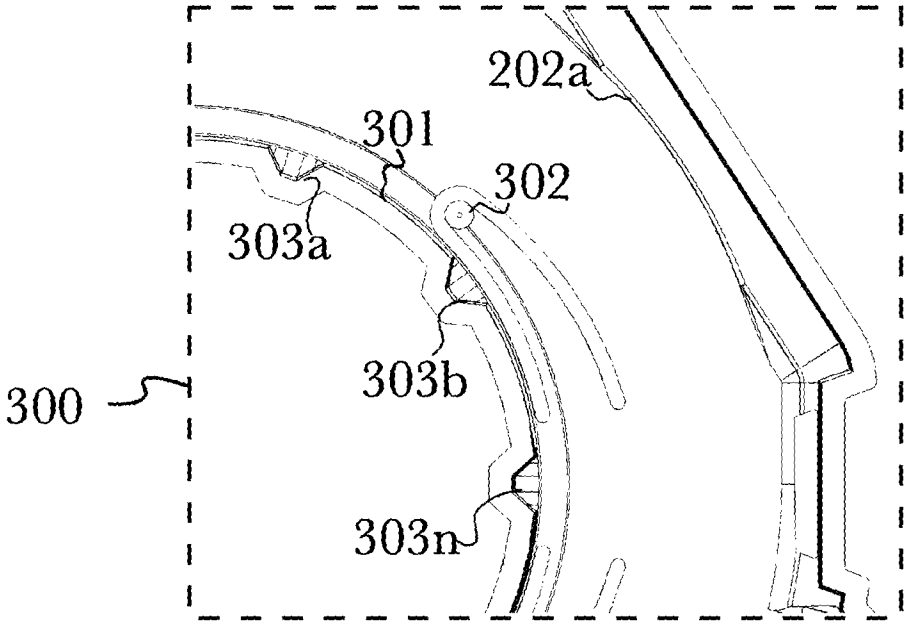
FIG. 3 is an illustration of an exemplary underside close up view of stripwise adhesive dispenser according to a preferred embodiment of the invention, illustrating where springs and strip adhesive assemble to device.

FIG. 3 is an illustration of an exemplary underside close-up view of stripwise adhesive dispenser according to a preferred embodiment of the invention, illustrating where springs and stripwise adhesive assemble 300 to device 100. Stripwise adhesive rests between bumper 202*a* and center wall 301, while core of strip adhesive (the object stripwise adhesive is wound about; core material may be cardboard or plastic) will connect to stationary lever arm nodule tip 302 for added flow consistency of stripwise adhesive as adhesive is pulled from dispenser 100. Indentations 303*a-n* hold springs (springs used may be, but are not limited to: leaf springs, coiled springs, molded wave springs, or others, and may be permanently affixed to device 100 such as by welding or industrial adhesives, or temporarily affixed to device 100 according to a desired use case) that push against device 100 and a roll of stripwise adhesive, keeping it locked in place.

Figure 4:
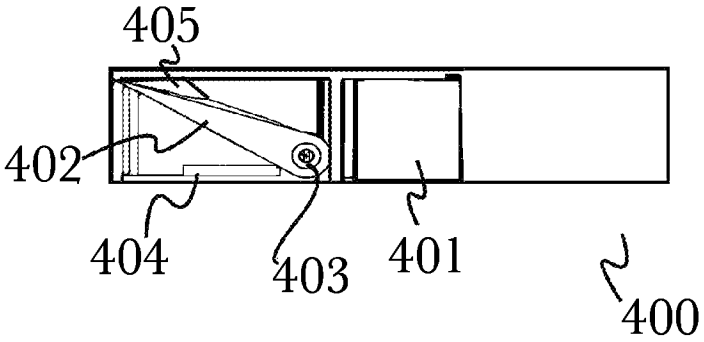
FIG. 4 is an illustration of an exemplary internal side view of stripwise adhesive dispenser according to a preferred embodiment of the invention, illustrating within device a blade for cutting stripwise adhesive.

FIG. 4 is an illustration of an exemplary internal side view of stripwise adhesive dispenser according to a preferred embodiment of the invention, illustrating within device 400 a blade for cutting stripwise adhesive. According to the embodiment, within device 400 above portion of device 401 for holding stripwise adhesive is blade 402 for severing stripwise adhesive. Blade 402 is thick at one end with a hollowed-out core for attaching to rotating pin 403. Blade 402 is secured in place partially by rotating pin 403 and by step levels 404; step levels 404 may be comprised of plastic or metal and have two levels (it should be appreciated that device may have more than two levels of step levels such as but not limited to one step, three steps, five steps, etc. according to a desired use case) for blade 402, with help of safety button 405 and rotating pin 403, to move blade 402 along step levels 404 to accommodate different widths of stripwise adhesives which can vary. Safety button 405 attaches to device cut-out 104*a* and rests on blade 402. Safety button 405 keeps device users from injury by blocking cut-out 104*a* but also can be pushed down on blade 402 to adjust blade 402 on step level 404 for varying stripwise adhesive widths.

Figure 5:
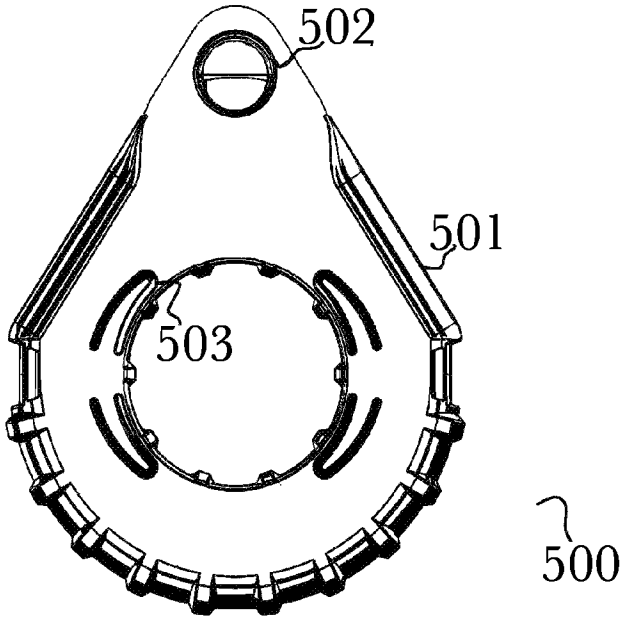
FIG. 5 is an illustration of an exemplary assembled stripwise adhesive dispenser according to a preferred embodiment of the invention, illustrating a top side view of device with blade and roll of stripwise adhesive assembled to device.

FIG. 5 is an illustration of an exemplary assembled stripwise adhesive dispenser according to a preferred embodiment of the invention, illustrating a top side view of device with blade and roll of stripwise adhesive assembled 500 to device. According to the embodiment, assembled device 500 comprises dispenser device 501 with blade assembly 502 attached to cut-outs 104*a*, 104*b* and safety button 405 visible from top view. Stripwise adhesive 503 can be seen through cut-outs 105*a-n* and attaches to the underside of device 500 by attaching adhesive 503 core to stationary lever arm nodule tips 302, while adhesive 503 rests between device walls 301 and bumpers 202*a*, 202*b*.

The skilled person will be aware of a range of possible modifications of the various embodiments described above. Accordingly, the present invention is defined by the claims and their equivalents.

What is claimed is:

1. A stripwise adhesive dispensing device, comprising:

a bisected lachrymiform body formed from a rigid material and having a bottom portion having a first width, a tapered top portion having a smaller second width, a plurality of circular cut-outs formed into the body;

a cutting blade; and a plurality of springs;

wherein at least a circular cut-out is configured to hold a spring;

wherein the bisected lachrymiform body and the held spring are configured to hold a roll of stripwise adhesive securely in place;

wherein the cutting blade is configured to be movable to accommodate width variation of the held stripwise adhesive; and wherein the held stripwise adhesive is positioned and oriented for dispensation without interfering with or damaging an adhesive portion of the held stripwise adhesive.

2. The device of claim 1, wherein the bottom portion further comprises:

a plurality of cut-outs;

a plurality of stationary lever arms, each lever arm further comprising at least a nodular tip; and wherein the plurality of lever arms are is configured to hold stripwise adhesive.

3. The device of claim 2, wherein the stripwise adhesive is configured as a roll.

4. The apparatus of claim 1, wherein the top portion further comprises an additional cut-out, wherein the cutting blade is affixed to the additional cut-out.

* * * * *